US005706588A

United States Patent [19]

Dausch et al.

[11] Patent Number: 5,706,588

[45] Date of Patent: Jan. 13, 1998

[54] DEVICE AND METHOD FOR SEPARATING LINT PARTICLES IN A CLOTHES DRYER

[75] Inventors: Mark Edward Dausch, Latham; Seth Alexander Capello, Saratoga Springs, both of N.Y.; Youssef El-Shoubary, North Brunswick, N.J.; Donald Richard Dickerson, Jr., Louisville, Ky.

[73] Assignee: General Electric Company, Schenectady, N.Y.

[21] Appl. No.: 708,071

[22] Filed: Aug. 13, 1996

[51] Int. Cl.[6] ..... F26B 5/08

[52] U.S. Cl. ..... 34/327; 34/480; 34/82; 34/604

[58] Field of Search ..... 34/321, 327, 480, 34/499, 82, 595, 602, 604, 607

[56] References Cited

U.S. PATENT DOCUMENTS

| | | | |
|---|---|---|---|
| 2,809,025 | 10/1957 | Pettyjohn | 34/604 X |
| 3,966,441 | 6/1976 | Freze | 34/82 X |
| 4,314,409 | 2/1982 | Cartier et al. | 34/604 X |
| 5,067,253 | 11/1991 | Hauch et al. | 34/82 |
| 5,210,960 | 5/1993 | LaRue | 34/82 |
| 5,226,203 | 7/1993 | Sacconato et al. | 34/282 X |
| 5,272,781 | 12/1993 | Bastin et al. | 34/427 X |

*Primary Examiner*—Henry A. Bennett
*Assistant Examiner*—Steve Gravini
*Attorney, Agent, or Firm*—David C. Goldman; Marvin Snyder

[57] ABSTRACT

The present invention discloses a device and method for separating lint particles in a clothes dryer. In the present invention, the device and method use a cyclone to separate the lint particles. The cyclone includes a housing container having an inlet port and an outlet port. A screen is positioned about the inlet port. A tubing extends through the outlet port into the housing container. A drawing means draws moisture and lint laden air from the clothes dryer through the screen. A circulating means circulates the moisture and lint laden air in the housing container about the tubing. A removing means removes the moisture and lint laden air from the housing container and retains any lint particles within the housing container. The cyclone improves upon the efficiency of accumulating lint particles without compromising the passage of air flow in the exhaust duct and improves upon the passage of air flow without decreasing the amount of lint particles being trapped.

8 Claims, 3 Drawing Sheets

DEVICE AND METHOD FOR SEPARATING LINT PARTICLES IN A CLOTHES DRYER

BACKGROUND OF THE INVENTION

The present invention relates generally to clothes dryers, and more particularly to separating lint particles from the exhaust air of a clothes dryer.

Typically, a clothes dryer includes a blower for pulling air out from a fabric tumbling chamber (i.e., a drum) through an exhaust duct. A screen or mesh type filter material located near the bottom of the door opening to the drum is used for separating and retaining lint particles from the air being pulled out of the drum by the blower. During the drying process, the screen filter traps the lint particles while allowing moist air from the drum to be passed through to the exhaust duct. Trapping the lint particles eliminates all possible potential fire hazards and ensures that the results of the drying process are not compromised.

In order to ensure that lint particles are trapped, the screen filter has to perform at an efficient level. The efficiency of a screen filter tends to be lower at the beginning of the drying process when the screen is clean. However, during the drying process, the lint particles accumulate on the screen filter, which assist in improving the efficiency of the filter, but cause a reduction in the air flow. A problem with currently available screen filters is that most filters cannot improve upon the efficiency of accumulating lint particles without compromising the passage of air flow in the exhaust duct or improving upon the passage of air flow without decreasing the amount of lint particles being trapped. For example, a coarse filter will allow sufficient air flow during the entire drying process, but is not very efficient at removing lint particles. In particular, the coarse filter allows more lint particles into the exhaust duct, increasing the potential for lint clogging up the exhaust duct and causing a fire. On the other hand, a fine screen filter may be more efficient at removing smaller lint particles, but tends to impede the air flow as the particles collect. This results in longer drying times, higher energy consumption, and the potential for damaging clothing.

SUMMARY OF THE INVENTION

Therefore, it is a primary objective of the present invention to provide a device and method that separates lint particles in a clothes dryer at a more efficient level than currently available screen filters without causing a reduction in the air flow.

Thus, in accordance with the present invention, there is provided a device for separating lint particles in a clothes dryer. The device comprises a housing container having an inlet port and an outlet port. A screen is positioned about the inlet port. A tubing extends through the outlet port into the housing container. A drawing means draws moisture and lint laden air from the clothes dryer through the screen. A circulating means circulates the moisture and lint laden air in the housing container about the tubing. A removing means removes the moisture and lint laden air from the housing container and retains any lint particles within the housing container.

In accordance with another embodiment of the present invention, there is provided a method for separating lint particles in a clothes dryer. The method comprises providing a housing container having an inlet port and an outlet port to the clothes dryer. A screen is positioned about the inlet port. A tube is placed through the outlet port extending into the housing container. Moisture and lint laden air is then drawn from the clothes dryer through the screen. The moisture and lint laden air is then circulated in the housing container about the tube. The moisture and lint laden air from the housing container is removed and any lint particles within the housing container is retained therein.

While the present invention will hereinafter be described in connection with a preferred embodiment and method of use, it will be understood that it is not intended to limit the invention to this embodiment. Instead, it is intended to cover all alternatives, modifications and equivalents as may be included within the spirit and scope of the present invention as defined by the appended claims.

DETAILED DESCRIPTION OF THE PRESENT INVENTION

Figure 1:
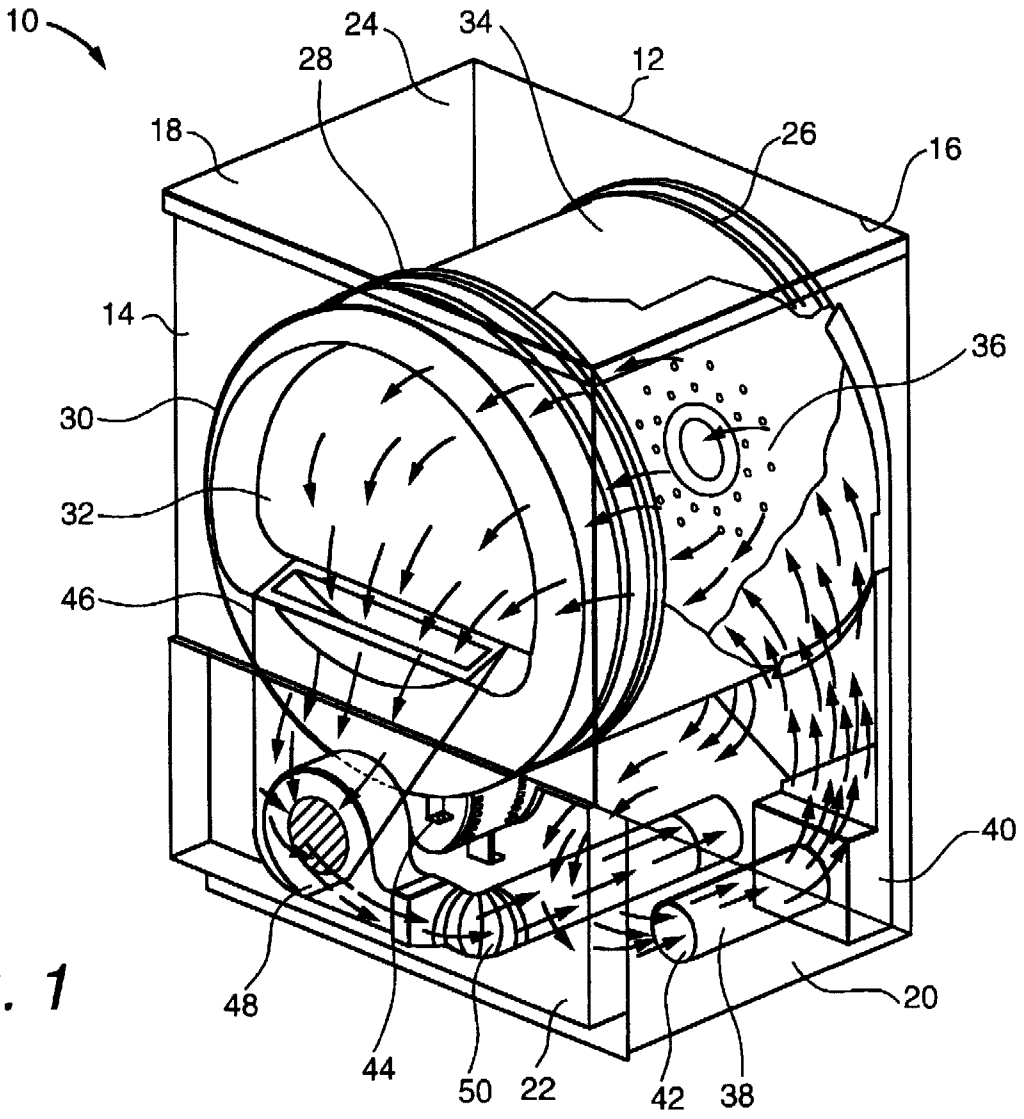
FIG. 1 shows a perspective view of a clothes dryer.

FIG. 1 shows a perspective view of a clothes dryer 10. The clothes dryer includes a cabinet or a main housing 12 having a front panel 14, a rear panel 16, a pair of side panels 18 and 20 spaced apart from each other by the front and rear panels, a bottom panel 22, and a top cover 24. Within the housing 12 is a drum 26 mounted for rotation around a substantially horizontal axis. The drum 26 is generally cylindrical in shape, having an imperforate outer cylindrical wall 28 and a front flange or wall 30 defining an opening 32 to the drum. Clothes and other fabrics are loaded into the drum 26 through the opening 32. A plurality of tumbling ribs(not shown) are provided within the drum 26 to lift fabrics and then allow them to tumble back to the bottom of the drum as the drum rotates. The drum 26 includes a rear wall 34 rotatably supported within the main housing 12 by a suitable fixed bearing. The rear wall 34 includes a plurality of holes 36 that receive hot air that has been heated by a combustion chamber 38 and a rear duct 40. The combustion chamber 38 receives ambient air via an inlet 42. Although the clothes dryer 10 shown in FIG. 1 is a gas driver, it could just as well be an electric dryer without the combustion chamber 38 and the rear duct 40. The heated air is drawn from the drum by a blower motor 44 to evaporate moisture from the fabrics in the drum. The air passes through a screen filter 46 which traps any lint particles. As the air passes through the screen filter 46, it enters a trap duct seal (permagum) 48 and is passed out of the clothes dryer through an exhaust duct 50. After the fabrics have been dried, they are removed from the drum 26 via the opening 32.

As mentioned above, there is a problem with using a screen filter to remove lint particles In particular, the currently available screen filters are unable to improve upon the efficiency of accumulating lint particles without compromising the passage of air flow in the exhaust duct or improving upon the passage of air flow without decreasing the amount of lint particles being trapped. The present invention has overcome the problem associated with the screen filter by replacing it with a cyclone 52. In particular, the cyclone 52 forces moisture and lint laden air to swirl within its body to produce a vortex. The vortex causes the heavier particles such as lint particles to be pulled to the outer regions of the vortex by centrifugal forces and continue swirling in the outer regions, while the lighter air particles exit the cyclone through the blower and the exhaust duct. The heavier particles such as lint remain within the cyclone for removal by the user after the drying cycle has ceased.

Figure 2:
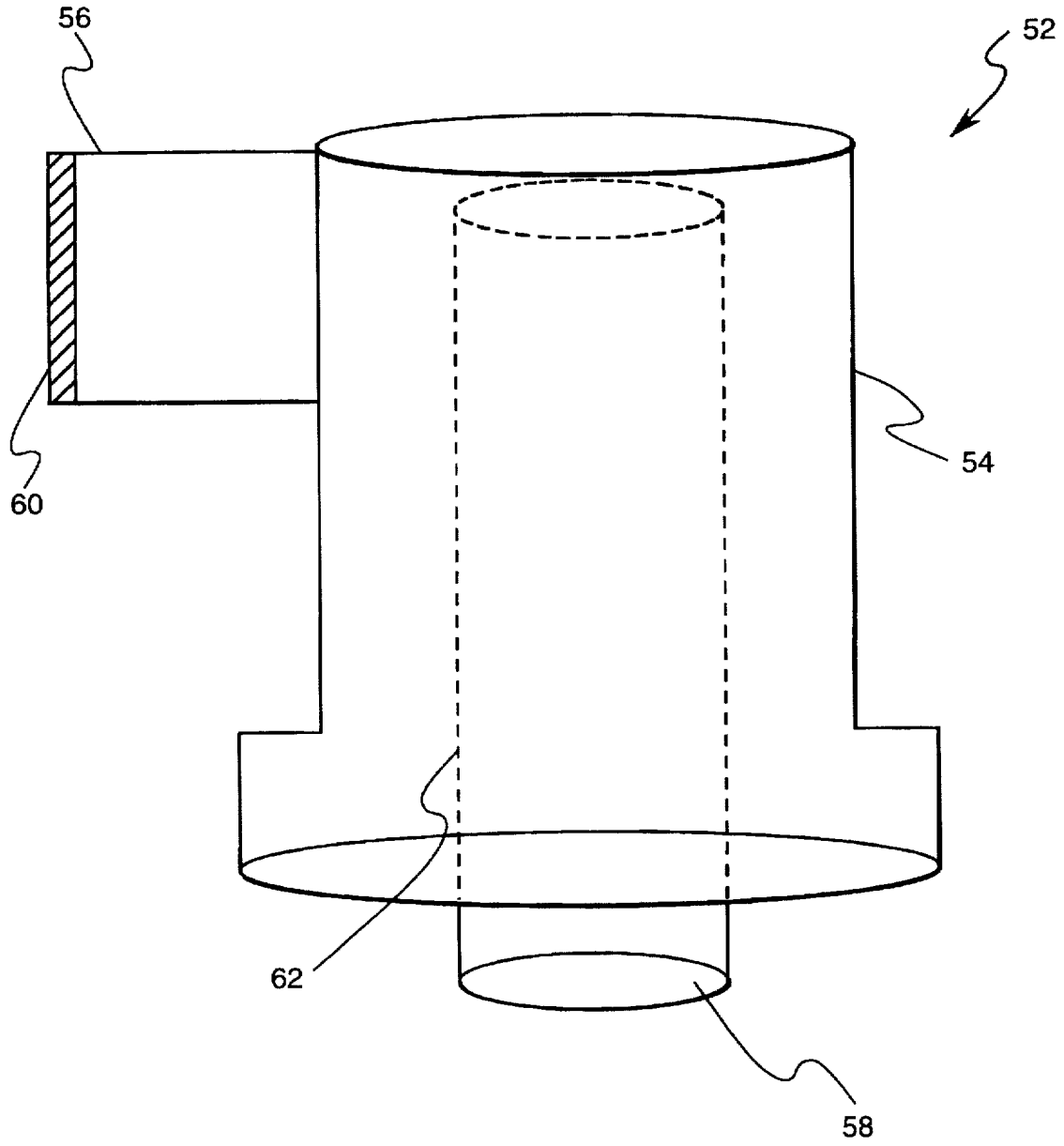
FIG. 2 shows a side view of the device for separating lint particles according to the present invention.

FIG. 2 shows a side view of the cyclone 52. The cyclone 52 is substituted for the screen filter 46 of the clothes dryer 10. The cyclone 52 includes a transparent housing container 54 which has an inlet port 56 and an outlet port 58. The inlet port 56 pulls the exhaust air from the drum 26, while the outlet port 58 directs the air to the trap duct seal 48 and the exhaust duct 50. A coarse screen 60 is positioned about the inlet port for preventing fabrics from entering the cyclone 52. A cylinder tubing 62 extends through the outlet port into the housing container 54. Since the air entering the inlet port 56 is tangential to the air exiting the tubing 62 at the outlet port 58, a vortex is created. The vortex causes the air to circulate in the cylindrical region between the tubing 62 and the housing container 54. The heavier particles such as the lint particles are pulled to the outer regions of the vortex by the centrifugal forces and continue swirling in this region, while the lighter air particles exit through the tubing 62 and the outlet port 58. The heavier particles such as lint remain within the cyclone at the bottom of the housing container 54.

Figure 3:
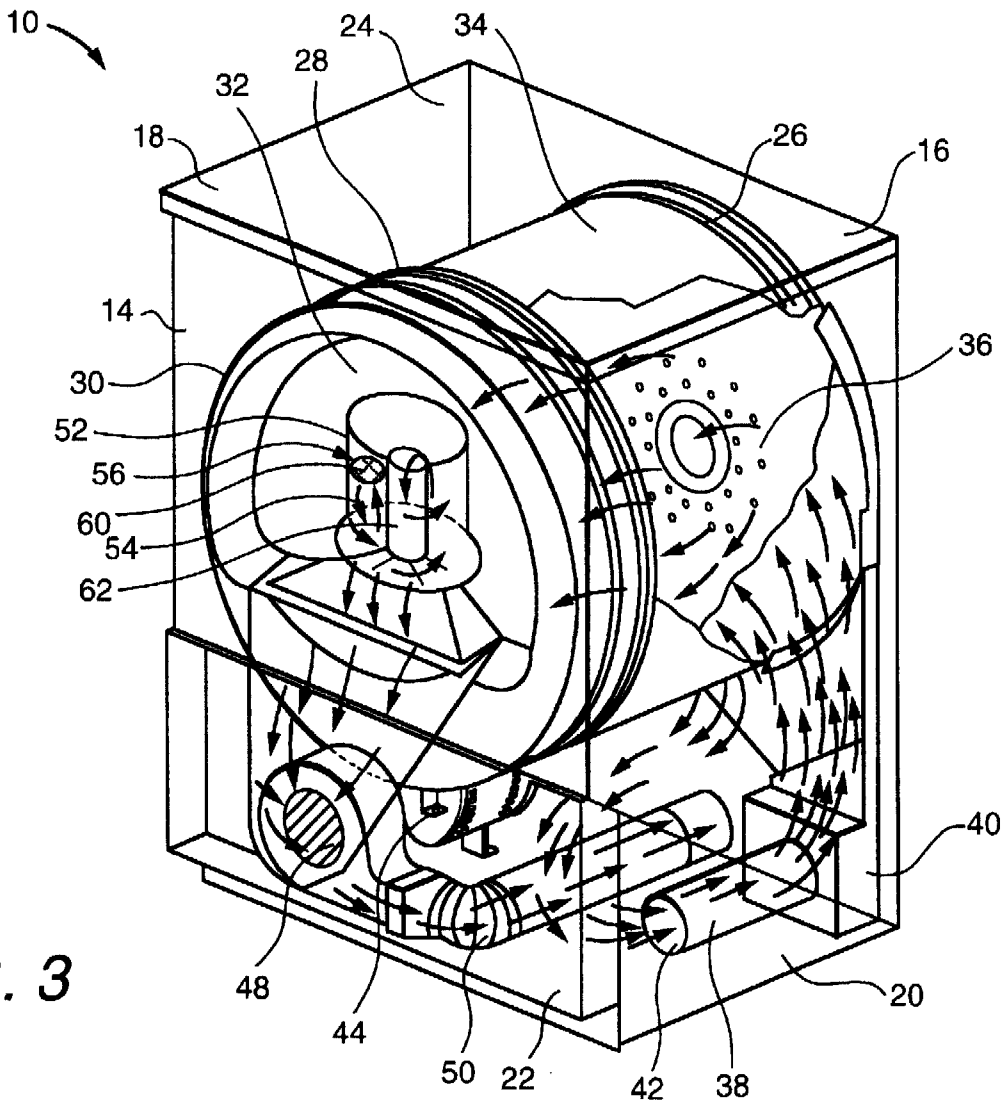
FIG. 3 shows a perspective view of a clothes dryer incorporating the device for separating lint particles according to the present invention.

FIG. 3 shows a perspective view of the clothes dryer 10 incorporating the cyclone device 52 for separating lint particles. The cyclone 52 is substituted for the screen filter 46 of the clothes dryer 10. Although the cyclone 52 is fitted into the location of the screen filter, it is within the scope of the present invention to place the cyclone in any area within the clothes dryer that is easily accessible to the user. During the drying operation of the clothes dryer 10 with the cyclone 52, ambient air enters the dryer at the inlet 42. The air is heated by the combustion chamber 38 and the rear duct 40. In particular, the air is heated to temperatures as high as 375° F. The heated air is directed to the plurality of holes 36 located on the rear wall 34. The heated air passes over and through the fabrics as the fabrics rotate and drop within the rotating drum 26. As the air moves over and through the articles, the air picks up water moisture from the water evaporating from the fabrics and lint particles that were loosened by the tumbling action. The moisture and lint laden air exits the drum 26 into the cyclone 52 through the inlet port 56. Because the air entering the inlet port 56 is tangential to the air exiting the tubing 62 at the outlet port 58, a vortex is created. The vortex causes the air to circulate in the cylindrical region between the tubing 62 and the housing container 54. The heavier particles such as the lint particles are pulled to the outer regions of the vortex by the centrifugal forces and continue swirling in this region, while the lighter air particles exit through the tubing 62 and the outlet port 58. Once the air exits the cyclone 52, it passes through the trap duct seal 48 and is passed out of the clothes dryer through the exhaust duct 50. The heavier particles such as lint remain within the cyclone for removal by the user after the drying cycle has ended.

The cyclone 52 provides various advantages over the lint screen filters. For example, it has been determined that the cyclone provides about a 4% to 5% efficiency improvement in removing lint particles compared to the conventional lint screen filter. The cyclone maintains the same high level of efficiency throughout the drying cycle, whereas the efficiency level of the lint screen filter tends to be lower at the beginning of the cycle when the screen is clean and gradually improves during the drying process. Another advantage of the present invention is that when the housing container of the cyclone becomes full, then the air flow is not restricted as with the lint screen filter. Still another advantage of the present invention is that the cyclone is transparent, making the accumulation of lint particles visible to the user. The transparency increases the chances that the user will see the lint particle accumulation and empty the cyclone. Another advantage of the present invention is that it is very easy to remove the cyclone and remove any lint particle accumulation from its housing container.

It is therefore apparent that there has been provided in accordance with the present invention, a device and method for separating lint from a clothes dryer that fully satisfy the aims and advantages and objectives hereinbefore set forth. The invention has been described with reference to several embodiments, however, it will be appreciated that variations and modifications can be effected by a person of ordinary skill in the art without departing from the scope of the invention.

The invention claimed is:

1. A device for separating lint particles in a clothes dryer, comprising:

a housing container having an inlet port and an outlet port;

a screen positioned about the inlet port;

a tubing extending through the outlet port into the housing container;

means for drawing moisture and lint laden air from the clothes dryer into the screen;

means for circulating the moisture and lint laden air in the housing container about the tubing wherein the circulating means produces a vortex within the housing container, wherein the moisture and lint laden air circulate in a region between the tubing and the housing container, wherein lint particles are moved to outer regions of the vortex by centrifugal forces while air particles are maintained within inner regions of the vortex; and means for removing the moisture and lint laden air from the housing container and retaining any lint particles within the housing container.

2. The device according to claim 1, wherein the tubing is cylindrically-shaped.

3. The device according to claim 1, wherein the housing container is transparent.

4. The device according to claim 1, wherein the removing means removes the air particles from the inner regions of the vortex through the outlet port.

5. The device according to claim 1, wherein the drawing means draws the moisture and lint laden air tangentially to the moisture and lint laden air removed by the removing means.

6. A method for separating lint particles in a clothes dryer, comprising:

providing a housing container having an inlet port and an outlet port to the clothes dryer; positioning a screen about the inlet port;

placing a tube through the outlet port extending into the housing container;

drawing moisture and lint laden air from the clothes dryer through the screen;

circulating the moisture and lint laden air in the housing container about the tube wherein the circulation comprises producing a vortex within the housing container, wherein the moisture and lint laded air circulate in a region between the tube and the housing container, wherein lint particles are moved to outer regions of the vortex by centrifugal forces while air particles are maintained within inner regions of the vortex; and removing the moisture and lint laden air from the housing container and retaining any lint particles within the housing container.

7. The method according to claim 6, wherein the removing step removes the air particles from the inner regions of the vortex through the outlet port.

8. The method according to claim 6, wherein the drawn moisture and lint laden air is tangential to the removed moisture and lint laden air.

* * * * *